United States Patent [19]

Day, Jr.

[11] Patent Number: 4,967,814

[45] Date of Patent: Nov. 6, 1990

[54] APPARATUS FOR FILLING HIGH PRESSURE GAS STORAGE BOTTLES WITH POWDERED ACTIVATED CARBON

[75] Inventor: Carl B. Day, Jr., Lexington, Va.

[73] Assignee: Westvaco Corporation, New York, N.Y.

[21] Appl. No.: 352,982

[22] Filed: Jun. 23, 1989

Related U.S. Application Data

[62] Division of Ser. No. 245,726, Sep. 19, 1988.

[51] Int. Cl.[5] ..... B65B 1/04; B65B 3/04

[52] U.S. Cl. ..... 141/286; 141/59; 141/384; 141/234

[58] Field of Search ..... 141/5, 7, 8, 12, 18, 141/59, 52, 60, 53, 61, 65, 67, 71, 73, 74, 80, 236, 237, 242, 243, 244, 285, 286, 382, 383, 384, 386, 4; 220/85 F, 85 R

[56] References Cited

U.S. PATENT DOCUMENTS

| | | | |
|---|---|---|---|
| 773,876 | 11/1904 | Lorillard | 141/8 |
| 2,645,907 | 7/1953 | Droste et al. | 141/4 X |
| 2,675,951 | 4/1954 | Oriol | 141/59 X |
| 2,680,546 | 6/1954 | Seaberg | 141/384 |
| 2,738,119 | 3/1956 | Haygarth | 141/59 |
| 2,802,492 | 8/1957 | Gosselin | 141/52 X |
| 3,024,044 | 3/1962 | Benevento | 141/4 X |
| 3,078,685 | 2/1963 | Flournoy | 141/59 X |
| 3,195,786 | 7/1965 | Vogt | 141/7 X |
| 3,421,554 | 1/1969 | Carter | 141/7 |
| 3,640,320 | 2/1972 | Elkuch | 141/59 |
| 3,693,672 | 9/1972 | Hiland | 141/7 |
| 4,341,244 | 7/1982 | Facchini | 141/18 |
| 4,341,245 | 7/1982 | Daicho et al. | 141/18 |

*Primary Examiner*—Ernest G. Cusick

*Attorney, Agent, or Firm*—W. A. Marcontell; R. L. Schalz

[57] ABSTRACT

High pressure gas storage bottle with a single, small diameter filler neck aperture are charged with a powdered adsorbent such as activated carbon by drawing an evacuation air flow from the bottle receptacle at a point slightly below the filler neck. A charging fitting comprises a chambered body having an O-ring seal base which is clamped against the bottle nipple face by a compression nut. A length of rigid tubing having a tubular filter of pressed, microsphere tube walls at the distal or lower end thereof, descends through the body chamber and filler neck aperture. The tubular flow channel is connected to a vacuum source whereas the body chamber is connected to a powdered adsorbent supply conduit.

4 Claims, 1 Drawing Sheet

APPARATUS FOR FILLING HIGH PRESSURE GAS STORAGE BOTTLES WITH POWDERED ACTIVATED CARBON

This is a division of application Ser. No. 07/245,726, filed 09/19/88.

BACKGROUND OF THE INVENTION

1. Field Of Invention

The present invention generally relates to the art of pressurized fuel gas encapsulation. More specifically, the invention teaches a method and apparatus for maximizing the charge of low density powdered adsorbent into a high pressure fuel gas storage bottle.

2. Prior Art

It is known to those with skill in the prior art of fuel gas use and distribution that certain adsorbents, such as activated carbon, have an affinity for natural gas, propane and many other hydrocarbons. The system of U.S. Pat. No. 4,749,384 to J. J. Nowobilski et al is representative. Such affinity may be exploited by charging pressurized gas storage bottles or cylinders with adsorbent prior to a charge of fuel gas. This procedural device permits a lower confinement pressure for a given weight of gas within the fixed volume confinement of the bottle: an extremely significant safety and economic advantage.

High pressure, 2000 psi and greater, industrial gas bottles are predominately fabricated from steel using numerous welding, normalizing, heat treating and testing procedures. For this reason, it is not practical to charge a bottle with adsorbent before the last step of the fabrication process is complete. Conversely, for structural reasons, these bottles are made with a single, small diameter opening at one axial end of about one inch diameter. This single opening is used for both filling and extracting the fuel gas. Accordingly, this bottle filler opening constitutes a physical limitation on the absorbent characteristics and the rate of adsorbent charging.

Under these conditions and limitations, it has been the existing state of the art to charge industrial bottles with granular or pelletized forms of adsorbent: notwithstanding the fact that considerable density or volumetric efficiency is sacrificed in comparison to the theoretically possible density of powdered adsorbent.

Although powdered activated carbon is theoretically a superior industrial bottled gas adsorbent, it has, in the past, been an impractical material for this use. Due to an extremely fine particle size, 3 to 90 microns and a low density of less than 30 pounds per cubic foot, the material tends to aerate when transported in a flow stream. For example, a typical wood-based powdered activated carbon may have a packed bulk density of 28 pounds per cubic foot. After aeration by flow transport, however, the bulk density is reduced to 12 to 16 pounds per cubic foot: a 50% loss of density. Translated in terms of gas adsorption capacity, industrial gas bottles of a given volumetric capacity, due to aeration, may be filled to only 50% of packed capacity. Consequently, the quantity of fuel gas adsorbed on such a bottled carbon bed is restricted accordingly.

It is an objective of the present invention, therefore, to provide a process for filling an industrial gas bottle with a bed of powdered activated carbon packed to bulk density that is 90 to 95% as dense as is theoretically possible for the particular carbon.

Another objective of the present invention is to provide a process for continuously flowing low density powdered, adsorbent into an industrial gas bottle within a totally enclosed and dustless atmosphere.

Another objective of the present invention is to provide a process for filling standard industrial gas bottles with low density powdered, adsorbent within an elapsed time of only 2 to 10 minutes.

Another objective of the present invention is to provide a manifold filling line for flowing low density powdered, adsorbent simultaneously into several industrial gas bottles.

Another objective of the present invention is to provide an apparatus for drawing low density powdered, adsorbent into the closed confinement of an industrial gas bottle.

Another objective of the present invention is to provide an apparatus for simultaneously drawing a flow stream of low density powdered, adsorbent into an industrial gas bottle and compacting the accumulated bed to as much as 95% of a maximally compacted adsorbent bed.

SUMMARY OF THE INVENTION

These and other objects of the invention are accomplished by means of an apparatus comprising a vibrating bottle stand and a bottle fill fitting. The fill fitting is basically a pipe tee having three joint ends, two of which are on opposite ends of the tee run and the third at the base of the tee leg. One of the tee run joints is secured to the bottle opening while the other tee run joint secures a vacuum conduit that terminates with a length of porous wall tubing positioned below the bottle neck. The tee leg joint receives the downstream end of a powdered carbon flow conduit connected at its upstream end to a carbon supply bed. A vacuum drawn through the vacuum conduit initially evacuates the bottle interior and subsequently induces a flow of powdered carbon through the supply conduit. As the carbon enters the bottle, it must fall past the porous end of the vacuum tube which drafts air entrained with the powder.

Simultaneous with the carbon induction and evacuation, the bottle is being vibrated at a frequency of 80 to 300 cycles per minute over an amplitude of $\frac{3}{8}$ inch to 1 inch oriented along the bottle axis. As the carbon falls to the bottle bottom and top of the accumulated bed, the powder particles are arranged by vibration and gravity into the most compact alignment.

DESCRIPTION OF THE DRAWINGS

Relative to the drawings wherein like reference characters designate like or similar elements throughout either of the two figures.

DESCRIPTION OF THE PREFERRED EMBODIMENT

Although the working material of the invention is hereafter described as powdered activated carbon, it should be understood that the invention principles are applicable to any flowable particulate and most particularly to all powdered or granular adsorbents.

Figure 1:
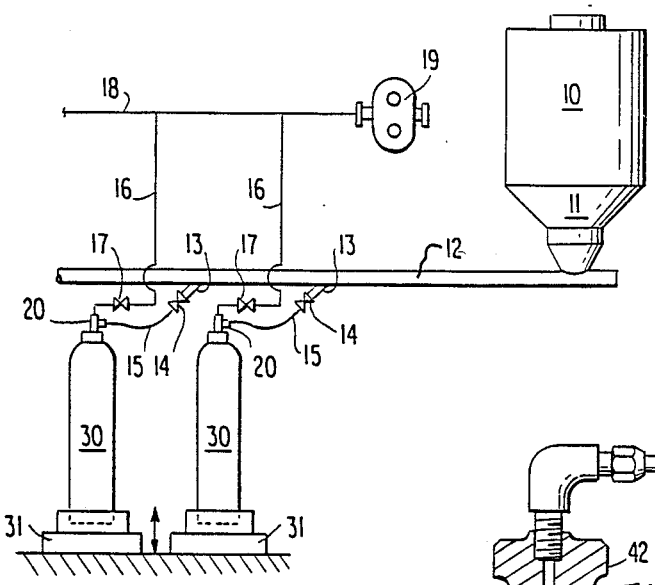
FIG. 1 is a schematic of the present invention system apparatus.

With reference to the system schematic of FIG. 1, a hopper vessel 10 holds a bulk quantity of the powdered absorbent for bottom feeding through a funnel 11 into a manifold conduit 12. Along the conduit 12 length are as many Y fittings 13 as the system is designed to accommodate. Preferably, the opening of each Y fitting is opened or closed by a valve or baffle plate 14. Downstream of each valve 14, a reinforced flexible hose 15 of about 1 inch nominal size connects the supply manifold to a filling fitting 20 secured to the top opening of respective industrial bottles 30.

Also connected to the fill fitting 20 is a flexible vacuum hose 16 and valve 17 which communicates the bottle 30 interior with a vacuum manifold 18 and air pump 19.

The base of each bottle 30 is set into a vibrating fixture 31 which cycles at the rate of 80 to 300 cycles per minute over an amplitude of 0.375 to 1.0 inch. The dominance of such vibrational displacement should be oriented parallel with the bottle axis. As represented, the vibrating fixtures 31 are each independent of the others but it is acceptable to provide a single table or stand for vibrating all bottles in the system collectively.

Figure 2:
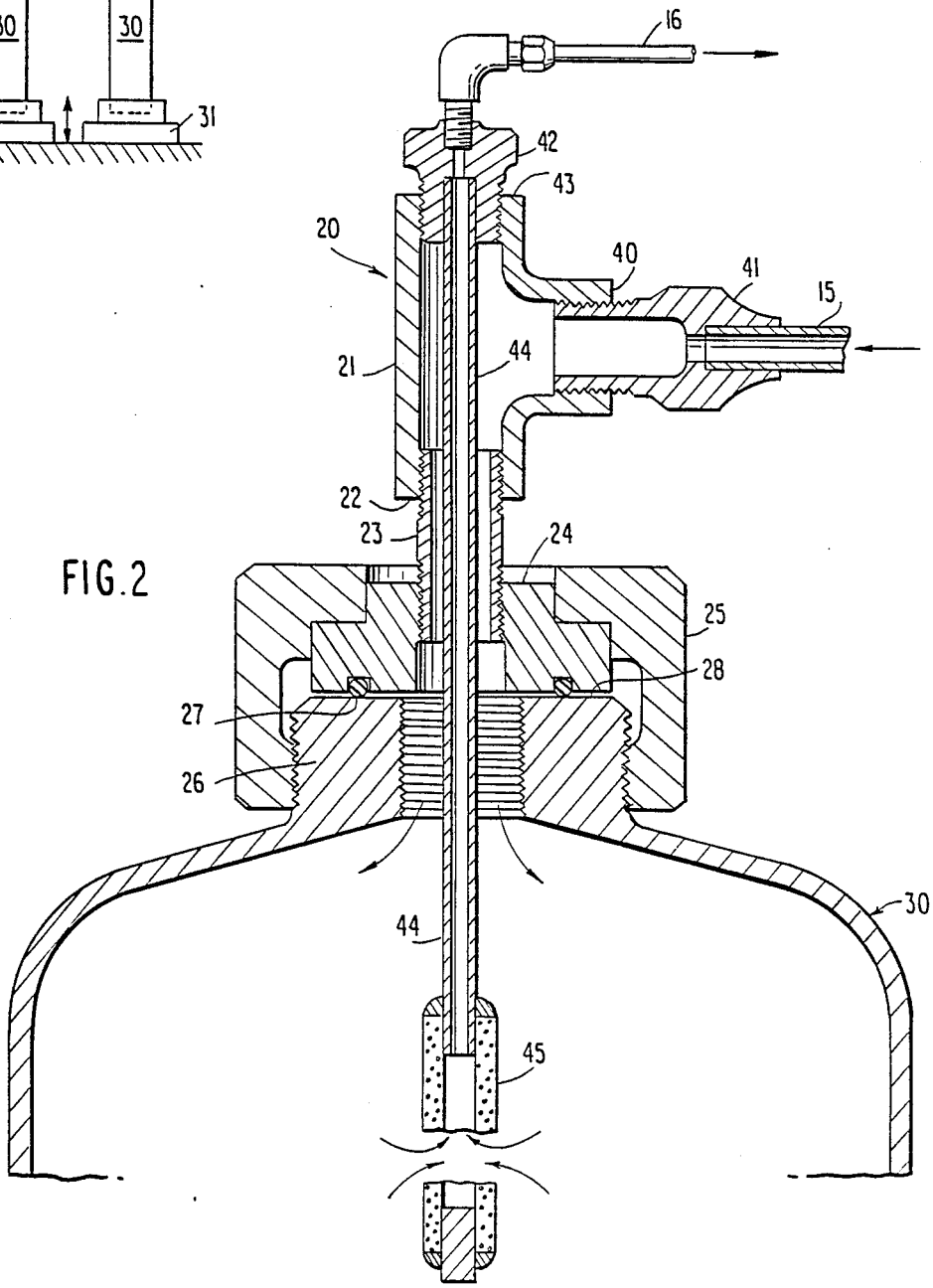
FIG. 2 is a partial sectional view of the bottle fill fitting apparatus of the present invention.

Relative to FIG. 2, the fill fitting body 20 may be fabricated from a standard piping tee 21 having one run opening 22 connected by a close nipple 23 to a compression seal base 24. Compression nut 25 threads onto the appliance fastening external threads of the bottle nipple 26. A flanged collar portion of the compression nut 25 bears against a corresponding shoulder ring portion of the seal base 24 to press the sealing O-ring 27 on the seal base 24 into sealing contact with the bottle nipple face 28 as the compression nut threads advance upon the bottle nipple threads.

Tee leg joint 40 of fill fitting body 20 receives a threaded tubing nut 41 to connect carbon supply hose 15. At the upper end of the fitting 20, vacuum hose 16 is connected by tubing nut 42 into the other tee run opening 43.

Secured coaxially to the tubing nut 42 and in communication with the flow channel therein, is a rigid tube 44 which extends through the internal chamber of the tee fitting, nipple 23 and the bottle nipple 26 into the interior of bottle 30. From the lower end of tube 44, a microporous filter comprising a porous wall tube 45 of about 1.0 cm outside diameter and 0.8 cm inside diameter projects axially another 15 to 20 cm. The entire length of rigid tubular projection 44 and 45 is about 30 to 40 cm. Selected for use with 3 to 90 micron particle size powdered activated carbon was a porous wall tube of sintered fabrication with 0.5 to 5.0 micron diameter metallic (stainless steel) beads manufactured by Newmet-Krebsoge of Terryville, Conn.

Using a fill fitting 20 of the foregoing specification, an initial air displacement rate of 3.0 scfm produced a draw of 12 inch Hg. vacuum within a 0.885 cubic foot bottle volume. When supplied through a 1 inch nominal diameter carbon supply hose 15, the bottle was filled with a bulk density of 27 pounds per cubic foot in 8 minutes. Over the filling interval, vacuum within the bottle rose from 12 inches Hg. to 25 inches Hg. The 3 to 90 micron particle size wood-based activated carbon used in this example has 28 pounds per cubic foot maximum packed bulk density.

Having fully described my invention I claim:

1. A particulate material charging fitting adapted for use with a gas storage vessel having a fill/discharge opening into the interior of said vessel, said opening passes through a nipple structure of the vessel having a sealing surface surrounded by appliance fastening means, said charging fitting comprising:

body means having a sealing surface thereon;

resilient sealing means on the sealing surface of said body means surrounding a sealed area of said sealing surface;

mounting means associated with said body means and adapted to structurally connect with appliance fastening means of said vessel for compressing said resilient sealing means between said sealing surface of said body means and said sealing surface of said nipple structure of said storage vessel;

a chamber within said body means having an opening within the sealed area of said sealing surface of said body means and in alignment with said fill/discharge opening of said storage vessel when said mounting means is in structural connection with said appliance fastening means of said vessel;

tubing means secured at one end thereof to said body means and extended to project through said chamber and said chamber opening beyond said sealing surface of said body means for extension through said fill/discharge opening of said vessel and into said vessel interior, wall structure defined by said tubing means serving to define a first flow channel within said tubing means from a second flow channel formed by said chamber and chamber opening said first flow channel isolated from said second flow channel by said wall structure;

microporous filter means secured to an end of said tubing means opposite from said one end to screen particulate material within said interior of said vessel from entering said first flow channel;

first conduit connection means secured to said body means in fluid communication with said first flow channel for drawing a vacuum within said interior of said vessel interior; and, second conduit connection means secured to said body means in fluid communication with said second flow channel for carrying particulate material into said interior of said vessel through said second flow channel and past said filter means.

2. A fitting as described by claim 1 wherein said filter means is a tubular wall section having a fluid flow conduit therewithin obstructed at one end thereof, the other end being secured to said tubing means opposite end for fluid flow from said flow conduit of said tubular wall section into said first flow channel, walls of said tubular wall section of said filter means being formed of 0.5 to 5.0 micron size sintered metallic spheres.

3. A fitting as described by claim 2 wherein said appliance fastening means of said vessel comprises external threads about said nipple structure and said fitting mounting means comprises a flanged collar means having internal threads corresponding to the external threads of said vessel appliance fastening means, said body means defining a shoulder portion, wherein said flanged collar overlies said shoulder portion of said body means.

4. A fitting as described by claim 3 wherein said sealing means comprises a resilient O-ring between said sealing surface of said body means and said sealing surface of said nipple structure whereby said O-ring is compressed between said sealing surface of said body means and said sealing surface of said nipple structure by advancement of said flanged collar means threads upon said threads of said appliance fastening means.

* * * * *

UNITED STATES PATENT OFFICE

CERTIFICATE OF CORRECTION

PATENT NO. : 4,967,814

DATED : Nov. 6, 1990

INVENTOR(S) : Carl B. Day, Jr.

It is certified that error appears in the above-identified patent and that said Letters Patent is hereby corrected as shown below:

Cover page - Abstract, line 1, "bottle" should be --bottles--.
Column 4, line 37 (Claim 1, line 41), following "vessel" delete --interior--.

Signed and Sealed this

Twenty-fifth Day of February, 1992

*Attest:*

HARRY F. MANBECK, JR.

*Attesting Officer*

*Commissioner of Patents and Trademarks*